US006199716B1

(12) United States Patent
Mays et al.

(10) Patent No.: US 6,199,716 B1
(45) Date of Patent: Mar. 13, 2001

(54) RING REINFORCEMENT FOR CONVENTIONAL DRUM

(75) Inventors: Harry Mays; George Patton, both of Merced; Michael Morrison, Stockton, all of CA (US)

(73) Assignee: Grief Bros. Corporation, Merced, CA (US)

( * ) Notice: Subject to any disclaimer, the term of this patent is extended or adjusted under 35 U.S.C. 154(b) by 102 days.

(21) Appl. No.: 08/856,373

(22) Filed: May 14, 1997

(51) Int. Cl.[7] ..... B65D 1/42
(52) U.S. Cl. ..... 220/654
(58) Field of Search ..... 220/654, 600

(56) References Cited

U.S. PATENT DOCUMENTS 1,045,055 * 11/1912 Mittinger, Jr. ..... 220/623
2,269,617 * 1/1942 Borstel ..... 220/654
2,301,061 * 11/1942 Logeman ..... 220/600
2,445,730 * 7/1948 Kuhn ..... 220/654
2,813,655 * 11/1957 Hall ..... 220/654
3,186,583 * 6/1965 Zundel ..... 220/623
3,339,793 * 9/1967 Gerlovich ..... 220/623
3,929,249 * 12/1975 Sheppard ..... 220/654

* cited by examiner

*Primary Examiner*—Joseph M. Moy
(74) *Attorney, Agent, or Firm*—Townsend and Townsend and Crew LLP

(57) ABSTRACT

A ring reinforcement is utilized on the circular head and bottom of a conventional 55 gallon drum. The conventional drum contains a cylindrical steel body having the two conventional V-shaped ribs expanded into the sidewalls at the middle of the cylinder. The drum—when either of the open-head or closed-head variety—has a circular head and a circular bottom closing in sealed relationship with the drum interior. This circular head and circular bottom are reinforced by welding a drum-reinforcing rim preferably inside the barrel. It has been found that remarkable resistance to bulging results, enabling the barrel to be shipped with product with up to 25 psi pressure relative to the barrel exterior without objectional distortion.

4 Claims, 2 Drawing Sheets

RING REINFORCEMENT FOR CONVENTIONAL DRUM

This invention relates to conventional drums and more particularly to the reinforcement of the head and bottom of a conventional 55 gallon drum to prevent bulging of the drum when shipping product under mild pressure in the range of 25 psi and below.

BACKGROUND OF THE INVENTION

Conventional 55 gallon drums are produced in quantity and utilized to ship a broad range of liquid product. Unfortunately, these containers are generally unsuitable for shipping product with any appreciable vapor pressure. Simply stated, the drums bulge at their respective heads and bottoms. When this condition occurs, the drums are no longer stable when standing on their respective ends.

There is a need to ship product in 55 gallon drums under mild pressure. New refrigerants furnish an example.

Specifically, refrigerants replacing those refrigerants having CFC's (chlorofluorocarbons) are an example of such products. Simply stated, inexpensive containers capable of withstanding 25 psi without significant distortion are needed to ship these new refrigerants. Presuming that adequate reinforcement can be found, there is no reason why conventional and low cost 55 gallon drums cannot be utilized.

SUMMARY OF THE INVENTION

A ring reinforcement is utilized on the circular head and bottom of a conventional 55 gallon drum. The conventional drum contains a cylindrical steel body having the two conventional V-shaped ribs rolled into the sidewalls at the middle of the cylinder. The drum—when either of the open-head or closed-head variety—has a circular head and a circular bottom closing in sealed relationship with the drum interior. This circular head and circular bottom are reinforced by welding a drum-reinforcing rim preferably inside the barrel. It has been found that remarkable resistance to bulging results, enabling the barrel to be shipped with product with up to 33 psi pressure relative to the barrel exterior without objectional distortion.

DESCRIPTION OF THE PREFERRED EMBODIMENT

Figure 1:
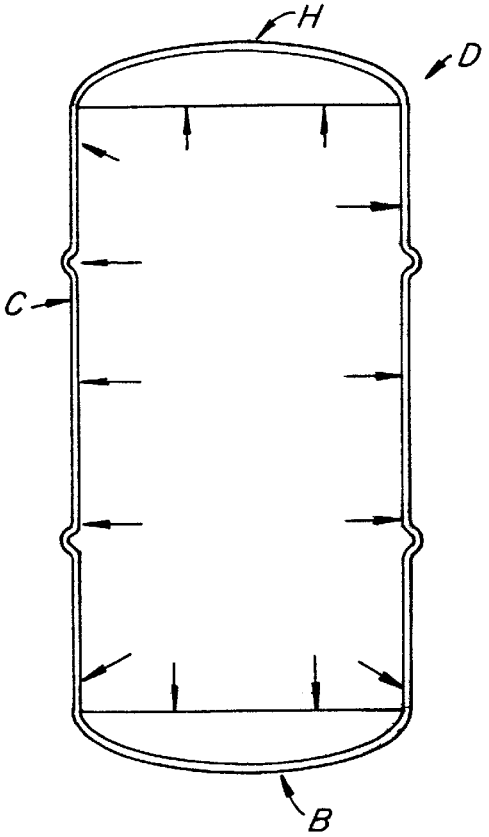
(PRIOR ART) FIG. 1.
FIG. 1 is a side elevation section of a prior art 55-gallon drum carrying a pressurized fluid with the head and bottom of the barrel bulging outward rendering the barrels unstable for shipment, especially when the barrels stand on their respective heads or bottoms.
Figure 6:
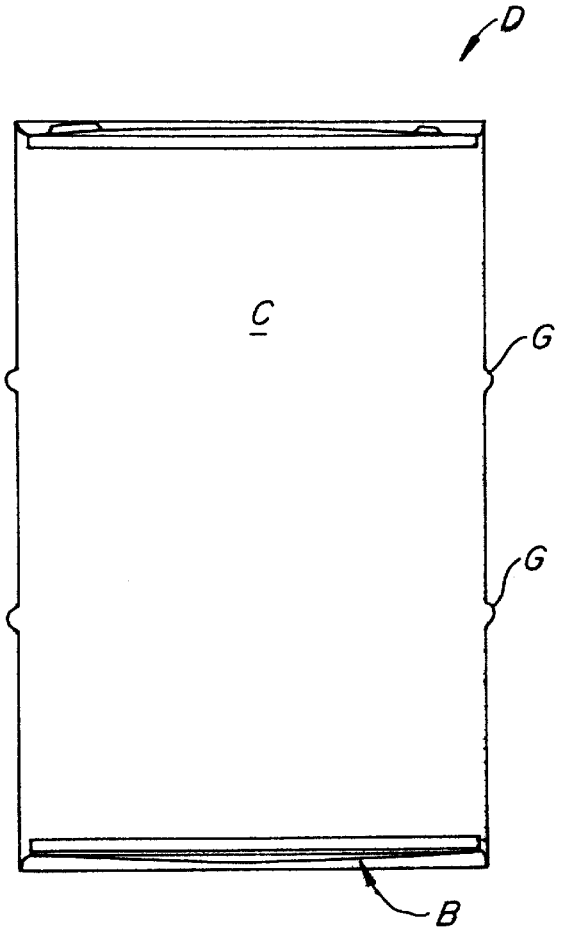
FIG. 6 is side elevation view similar to FIG. 1 illustrating the resistance of the head and bottom to bulging when shipping product attaining 25 psi of pressure.

With respect to FIG. 1, conventional steel drum D, identical in construction to that drum shown and described in FIG. 6, except for the presence of head or bottom reinforcing rim R, is illustrated. This drum is filled with fluid product exerting a fluid pressure exceeding 22 psi and less than 30 psi.

Conventional steel drum D includes cylindrical body C with rolled grooves G. Conventional steel drum D includes circular head H and circular bottom B. It will be seen that the drum has undergone a deformation at circular head H and circular bottom B which is known generically as "rocking." Specifically, this drum cannot sit on either circular head H or circular bottom B without rocking. It is unstable when stored or shipped standing on these ends.

It will also be understood that this drum will undergo the defect known as "starbursting" when loaded with product having a fluid pressure exceeding 18 psi. Specifically, starbursting consists of the drum head or bottom having visible top deformations adjacent the rim of the cylindrical body. It has been found that without the reinforcing rim of this invention, these characteristics occur with fluid loadings in excess of 18 psi, against 74 psi with the reinforcing rim of this invention.

It is the object of this invention to be able to ship product in a "conventionally shaped" and rim reinforced drum at fluid pressures of 25 psi or less. This being the case, head or bottom reinforcing rim R has been developed for attachment to circular head H and circular bottom B.

Figure 4:
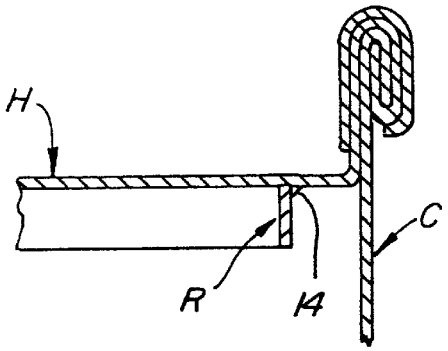
FIG. 4 is a detail of a drum with a reinforced head or bottom according to this disclosure illustrating the preferred dimensions.
Figure 5:
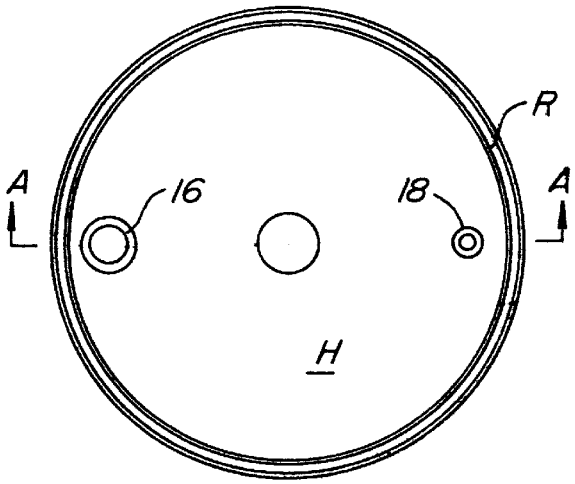
FIG. 5 is a plan view of the reinforced drum head or bottom.

Referring to FIGS. 4–6, the preferred embodiment of this head or bottom reinforcing rim R is illustrated in the detail of FIG. 4. Specifically, it is constructed from steel approximately ⅛ inch thick and welded to circular head H and circular bottom B. Head or bottom reinforcing rim R is about 1½ inches high and inset about ¼" to 1" inches from the side of cylindrical body C.

We find the view in plan shown in FIG. 5 surprising: head or bottom reinforcing rim R is inset such a small distance that in scale rim R is extremely close to the inside diameter of cylindrical body C. Dimensions have been left on the drawings so that the viewer can have a complete understanding of the construction here set forth.

Figure 2:
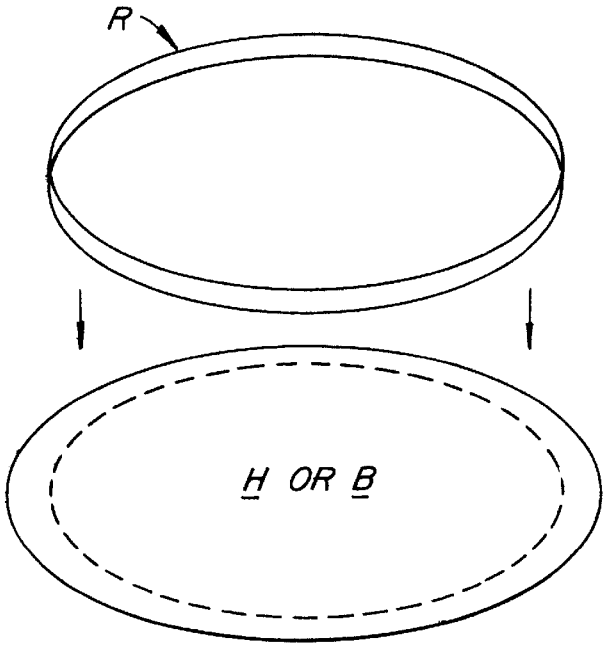
FIG. 2 is an exploded perspective view of a reinforcing ring overlying a head or bottom with the placed position of the reinforcing ring on the head or bottom being shown in broken lines.
Figure 3:
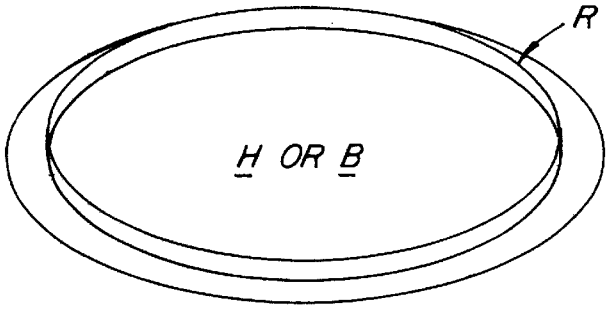
FIG. 3 is a perspective view similar to FIG. 2 with the reinforcing ring shown joined to the head or bottom for reinforcing the head or bottom for shipping of product with high vapor pressures.

Attachment of head or bottom reinforcing rim R to circular head H or circular bottom B is illustrated in FIGS. 2 and 3. Specifically, the attachment occurs at continuous weld 14. Placement of head or bottom reinforcing rim R on the inside of conventional steel drum D is preferred; but placement to the outside can occur as well.

It will be noted that in the details of FIGS. 4 and 5, we illustrate this invention utilized with a so-called "closed head" drum. In this type of drum, circular bung 16 and vent 18 are utilized. These are screw-fitting fixtures that enable removal of the barrel contents.

What is claimed is:

1. In the combination with a steel drum for containing a fluid under pressure having a cylindrical drum body having a diameter for defining open circular ends, the cylindrical drum body including a plurality of expanded circumferential rings configured about the cylindrical drum body;

a circular drum head closing one end of the cylindrical drum body; and, a circular drum bottom closing the other end of the cylindrical drum body;

the improvement to the circular drum head and the circular drum bottom comprising:

first and second reinforcing rims each having a cylindrical configuration and a diameter less than the diameter of the cylindrical drum body, the first and second reinforcing rims for placement to the circular drum head and the circular drum bottom, respectively; and, means for integrally fastening the first and second rims, respectively, to the circular head and bottom of the drum to increase resistance to bulging.

2. The combination with a steel drum for containing a fluid under pressure according to claim 1 wherein:

the means for integrally fastening the first and second rims, respectively, to the circular head and the circular bottom of the drum fastens the rim inside of the barrel.

3. A process for reinforcing the head and bottom of a steel drum for containing a fluid under pressure comprising the steps of:

providing a cylindrical drum body having a diameter for defining open circular ends, the drum body including a plurality of expanded circumferential rings configured about the cylindrical drum body;

providing a circular drum head closing one end of the cylindrical body;

providing a circular drum bottom closing the other end of the cylindrical body;

providing first and second reinforcing rims each having a cylindrical configuration and a diameter less than the diameter of the cylindrical drum body, the first and second reinforcing rims for placement to the circular drum head and the circular drum bottom respectively; and, integrally fastening the first and second rims respectively to the circular head and bottom of the drum to increase resistance to bulging.

4. A process for reinforcing the head and bottom of a steel drum for containing a fluid under pressure according to claim 3 wherein the step of:

integrally fastening the first and second rims, respectively, to the circular head and bottom of the drum includes fastening the rim to the inside of the barrel.

* * * * *